US007350475B2

(12) United States Patent
Borgwarth et al.

(10) Patent No.: US 7,350,475 B2
(45) Date of Patent: Apr. 1, 2008

(54) LAUNCH AND RECOVERY SYSTEM

(75) Inventors: Dennis W. Borgwarth, Andover, MN (US); Bradley J. Breeggemann, Maple Grove, MN (US)

(73) Assignee: BAE Systems Land & Armaments L.P., Arlington, VA (US)

( * ) Notice: Subject to any disclaimer, the term of this patent is extended or adjusted under 35 U.S.C. 154(b) by 0 days.

(21) Appl. No.: 11/522,859

(22) Filed: Sep. 18, 2006

(65) Prior Publication Data

US 2007/0137548 A1 Jun. 21, 2007

Related U.S. Application Data

(60) Provisional application No. 60/718,079, filed on Sep. 16, 2005.

(51) Int. Cl.
*B63B 35/40* (2006.01)

(52) U.S. Cl. ..... 114/260

(58) Field of Classification Search ..... 114/260
See application file for complete search history.

(56) References Cited

U.S. PATENT DOCUMENTS

| | | | | |
|---|---|---|---|---|
| 3,507,241 | A | 4/1970 | Southerland, Jr. et al. | |
| 3,937,163 | A | 2/1976 | Rosenberg | |
| 4,242,978 | A * | 1/1981 | Fuller | 114/253 |
| 4,864,957 | A | 9/1989 | Edgar et al. | |
| 5,241,920 | A * | 9/1993 | Richardson | 114/246 |
| 5,253,605 | A | 10/1993 | Collins | |
| 6,390,012 | B1 | 5/2002 | Watt et al. | |
| 6,431,105 | B2 | 8/2002 | Haram | |
| 6,698,376 | B2 | 3/2004 | Delahousse et al. | |
| 6,779,475 | B1 | 8/2004 | Crane et al. | |
| 6,782,842 | B1 | 8/2004 | Alvord | |

FOREIGN PATENT DOCUMENTS

| | | | |
|---|---|---|---|
| GB | 2 279 045 | A | 12/1994 |

* cited by examiner

*Primary Examiner*—Jesús D Sotelo
(74) *Attorney, Agent, or Firm*—Patterson, Thuente, Skaar & Christensen, P.A.

(57) ABSTRACT

A method and apparatus for launching and recovering an object by a host vessel while the host vessel is in motion. The recovery system utilizes a tethered capture system for connecting with the object and then directing the object to the host vessel where it is secured. The tethered capture system includes one or more side planers that direct a capture cable away from the host vessel. The capture cable is preferably disposed below the waterline through the use of a diving rig or extended cable struts so that the cable does not foul the propeller of the object to be recovered. The side planer itself may include a ramped surface for loading the object prior to securing to the host vessel. After the capture, the object may be secured by way of a boom attached to the host vessel or by a lifting cradle that selectively extends aft of the host vessel.

19 Claims, 8 Drawing Sheets

LAUNCH AND RECOVERY SYSTEM

RELATED APPLICATION

The present application claims the benefit of U.S. Provisional Application No. 60/718,079 filed Sep. 16, 2005, which is incorporated herein in its entirety by reference.

FIELD OF THE INVENTION

The present invention relates generally to a system for launching and recovering smaller vessels from a host vessel, and in particular to a method and apparatus for launching and recovering both underwater and surface craft during combat conditions without the need to deploy divers and while the host vessel maintains its speed.

BACKGROUND OF THE INVENTION

There is a need for a class of vessels that can counter enemy mines, submarines and fast attack craft in littoral waters. Such a vessel is being proposed by the U.S. Navy as the Littoral Combat Ship (LCS). The LCS is to be a small, fast, surface combatant that would use modular "plug-and-fight" mission payload packages, including unmanned vessels. The LCS must also be able to perform a host of secondary missions such as intelligence gathering, surveillance, reconnaissance, maritime intercept, special operations support, logistics support, mine clearing and homeland defense. The LCS acts as a host vessel to accomplish secondary missions performed through the use of manned or unmanned off-board vessels. For example, it is envisioned that the following types of off-board vessels may be used: rigid hull inflatable boats (RHIB), unmanned underwater vehicles (UUV), and unmanned surface vehicles (USV). These off-board vessels could simultaneously be performing such duties as mine clearing, reconnaissance and delivering special operations forces to shore. In order for a host vessel to perform these secondary missions, it would be preferable to provide a system that could quickly and efficiently perform launch and recovery activities of multiple types of off-board vessels. In addition, launch and recovery by the host vessel of such vessels must be possible day or night and in a variety of sea conditions.

Safety is a key concern during launch and recovery activities. In rough seas the recovery is further hampered by the vertical change or heave of the respective vessels due to waves. The launch and recovery must be done in such a fashion so as to avoid damage to the off-board vessel as well as the host ship. The act of bringing a smaller vessel on board a larger vessel obviously requires contact. However, colliding with the host vessel or the recovery apparatus, such as a winch, crane cables, or tethers, can damage surface and underwater vehicles.

One recovery technique is disclosed in Apparatus and Method for Deploying, Recovering, Servicing and Operating an Autonomous Underwater Vehicle (AUV), U.S. Pat. No. 6,390,012, wherein a tether is lowered under the host vessel from which a "latch" vehicle is deployed. The "latch" vehicle is remotely piloted to the AUV and then reconnected to the tether. The entire process occurs underwater so as to avoid the problem of heave, however, the system does not lend itself to recovery while the host vessel is moving. Moreover, the remote control aspect of the "latch" vehicle adds an extra layer of complexity.

One of the greatest dangers involved in the launch or recovery is discovery by an enemy while the LCS is vulnerable. As provided earlier, the LCS type vessel depends on speed for survivability. Therefore, the launch and recovery of an off-board vessel is preferably arranged while the host vessel is underway. One method of recovery involves driving the smaller vessel onto a ramp at the back of the ship. The ship can either be stationary or moving at a slower speed than the off-board vessel. This method requires a specially designed ship's architecture for the ramp and ample storage space. The smaller vessel must also have sufficient power to propel itself from the water onto the inclined ramp. In addition, a crane must also be included to lift the off-board vessel off of the ramp if more than one recovery is performed.

The alternative to the ramp is simply a deployed lifting device, which requires close contact between the two vessels. The launch and recovery is typically performed by a boom or crane attachment. For example, Launch and Recovery System for Unmanned Underwater vehicles, U.S. Pat. No. 6,779,475, describes a host vessel with stem end wall that converts to a ramp coupled with a boom that includes a capture mechanism. In this embodiment, the UUV must be directed to the surface within the reach of the boom while the host vessel is motionless. The UUV is directed by a homing signal on the boom for capture. Other lifting devices, such as Boat-Lift Systems and Methods, U.S. Pat. No. 6,782,842 also describes a lifting device mounted at the stem of a larger vessel. The smaller vessel must be directed to the stem for attachment. In both examples, capture and recovery is difficult in a heavy sea and impossible while the larger vessel is underway. In addition, a diver is sometimes required to assist in the connection or release of the off-board vessel.

In combat situations, speed and flexibility of the recovery system is paramount for completion of a successful mission. The examples illustrated require calm seas, divers to perform the connection between the lift and off-board vessel and good visibility. In littoral waters, secrecy and speed require the ability to launch and recover while the host vessel is moving. Furthermore, special operations and reconnaissance launches typically occur at night and in rough seas.

Therefore, there is a need for a launch and recovery system that can be performed while the ship is at speed. It is also preferable to avoid the use of divers in order to limit injury and the complexity of collecting and recovering both divers and the smaller vessel. Obviously, space is at a premium aboard a combat ship. There is also a need to minimize the size of the launch and recovery system aboard a ship. Accordingly, there is a need for a launch and recovery system that enhances the survivability of the host vessel, utilizes a minimum of deck space, and allows for the recovery of off-board vessels with a minimum of complexity.

SUMMARY OF THE INVENTION

The present invention is a shipboard launch and recovery system that improves upon the prior art examples. The present invention adds a capture system that greatly enhances the launch and recovery characteristics of the boom and crane system by incorporating side planers to assist in the capture of the off-board vehicle while the host vessel is underway. A side planer is a well known fishing device primarily used for moving a fishing line away from a vessel during trolling. The side planer includes one or more floats having an angled leading edge, the angle set so that relative contact with the water imparts a force that directs the planer away from the vessel. Here, the side planer directs a capture line towards the off-board vessel. Once the capture is complete, the off-board vessel is drawn onto a stow system disposed on the host vessel. The stow system can be a lifting device, preferably a lifting tray suspended from an overhead lift. The lifting tray supports the off-board vessel as it is raised onto the deck of the host vessel or advanced into a stern under deck storage area.

In the first embodiment, the capture of the off-board vessel includes the deployment from the host vessel of a capture system that includes two side planers connected by an underwater cable. The host vessel continues its course while it performs the launch or recovery. The capture system will preferably be deployed from the aft end of the host vessel. It is envisioned that a down diver or diver rig will also be attached to the cable at an intermediate point between the side planers. The relative velocity of the host vessel will direct the side planers outboard. The down diver will pull the cable below the surface between the side planers. The depth of the down diver will be determined by the type of off-board vessel to be captured. The off-board vessel will first deploy a capture hook either by a line or a fixed strut. As the off-board vessel maintains speed, the host vessel will advance at a greater speed than the off-board vessel and direct the capture system under the off-board vessel. The off-board vessel may be on the surface or underwater. The capture hook will be set at a depth so as to contact and attach to the capture cable. A winch system may then retrieve the capture system and direct the off-board vessel to the lift system of the host vessel.

Utilization of the first embodiment for launch and recovery of an off-board vessel has minimal impact on ship design. By dividing the recovery process into two steps, capture and stow, a wide variety of off-board vessels can be efficiently recovered. The use of the double planers allows the off-board vessel to be under power or awaiting capture. The present invention has greater flexibility in that the crew can further adjust the position of the planers relative to the host vessel by simply letting out or pulling in the cable.

In a second embodiment, both the host vessel and the off-board vessel will deploy cables with side planers to which a capture hook is attached. For example, the host vessel will deploy a single side planer from which a capture hook is attached. Likewise, the off-board vessel will deploy a single planer from which a capture hook is attached. The two vessels will proceed on a parallel course so that the side planer of the host vessel is directed inboard of the side planer of the off-board vessel. The crossing cables will result in at least one capture hook contacting at least one of the respective side planer cables. The off-board vessel may then be drawn to the host vessel by winch and loaded on-board by any acceptable method. By utilizing separate planers, there is never a risk of fouling the propeller of the off-board vessel. The separate planers also provide a means for adjusting the lengths of both capture systems. This may be especially valuable in poor visibility conditions where the crew of an off-board vessel may be better able to control the capture.

In a third embodiment, the host vessel deploys a cable with a side planer. A diving rig is suspended from the cable between the host vessel and the side planer so as to drift downstream of the side planer at a prescribed depth. The diving rig should be set at a depth greater than the expected depth of the propeller of the off-board vessel. The off-board vessel is required to deploy a catch hook. The host vessel with capture system deployed overtakes the off-board vessel as the host vessel continues under speed. The off-board vessel can be stationary or be moving at a velocity less than the host vessel. After the side planer passes close by the off-board vessel, the cable restraining the diving rig intercepts the catch hook. The cable is then winched toward the host vessel for recovery of the off-board vessel. The single planer concept eliminates rough water issues that arise with a two planer embodiment.

In a fourth embodiment of the present invention, the host vessel or mother ship is fitted with a side planning cradle that is selectively deployed by a cable winch system. The side-planning cradle is deployed aft of the host vessel while the host vessel maintains speed. The off-board vessel proceeds at a greater speed to overtake the side-planning cradle. The side-planning cradle includes a portion that travels below the surface. The off-board vessel increases speed relative to the side-planning cradle so as to propel itself on to the portion below the surface. It is envisioned that side-planning cradle would either be shorter than the off-board vessel or contain a channel to protect the propeller system of the off-board vessel during the capture process. Once the off-board vessel is disposed on the side planning cradle, the winch system would retrieve the off-board vessel. An existing boom or crane system would then raise the combined off-board vessel and side-planning cradle onto the host vessel. In an alternative embodiment, the side-planning cradle could remain attached to the boom or crane system for simply scooping an off-board vessel out of the water.

DETAILED DESCRIPTION OF THE DRAWINGS

The present invention provides an apparatus and a method for recovering or launching off-board vessels or cargo from a host vessel. The present invention utilizes the forward velocity of the host vessel to deploy and direct a capture system toward the intended off-board vessel. The capture system generally uses an asymmetrical body design so that the tethered capture system is forced away from the host vessel. The capture system further includes cables or a cable hook system for capturing the off-board vessel. After capture, the same unit that was used to deploy the capture system can be used to retrieve the off-board vessel. As the off-board vessel approaches the host vessel a stow system is utilized to secure the off-board vessel to the host vessel. In launching, the stow system is used to lower the off-board vessel to the water, while the capture system may be used to direct the off-board vessel away from the host vessel.

Figure 1:
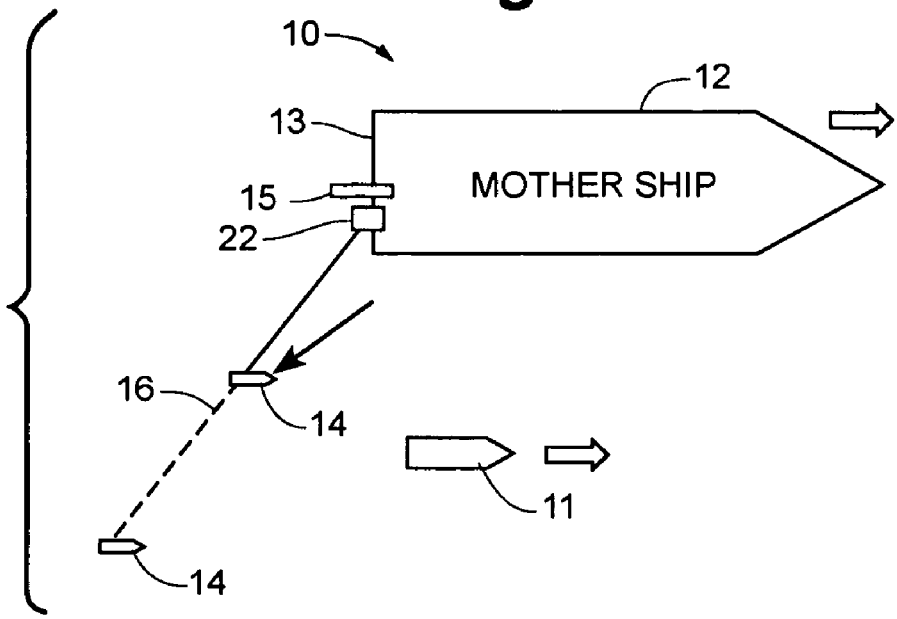
FIG. 1 includes an overhead view of the first embodiment of the present invention.
Figure 2:
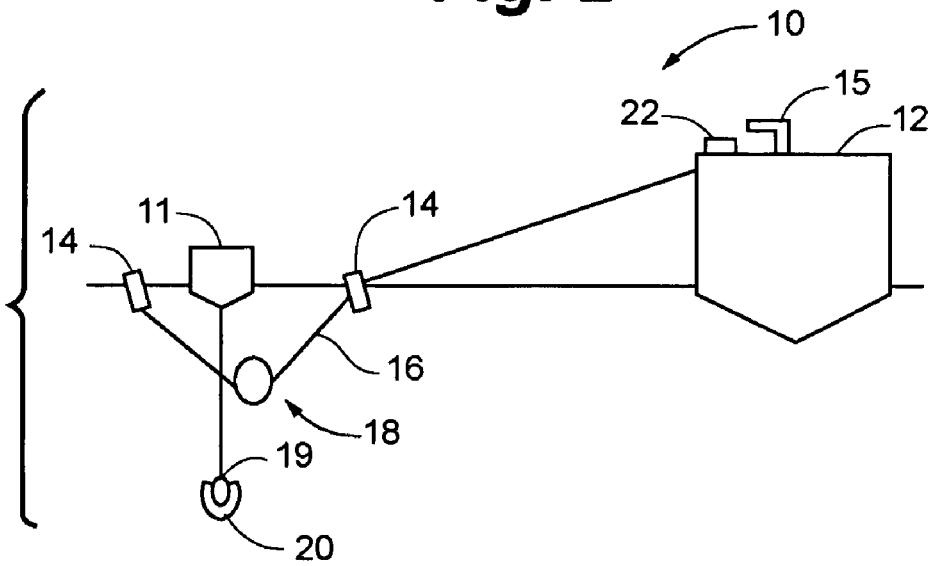
FIG. 2 includes a front view of the first embodiment of the present invention.

In a first embodiment, as illustrated in FIGS. 1 and 2, the capture system 10 includes the deployment from the host vessel 12 of two side planers 14 connected by an underwater cable 16. The side planers 14 are typically used in the fishing industry to move lines away from the vessel. For the purpose of this invention, a side planer is a floating body having a fuselage, wing or board shape and further including a system for positioning the planer body in the water. The side planer also includes an attachment point for a line or cable. The side planer body is constructed so that water striking the leading edge forces the planer outboard from the towing vessel. For example, the bow or leading edge of the side planer is constructed of a flat face intersecting an angled face. There are many side planer designs commercially available, such a single board design illustrated by U.S. Pat. No. 5,875,583, Planer Board, assigned to Church Tackle Company, Sodus Mich. and multi-board designs such as U.S. Pat. No. 5,341,591, Planer Boards, assigned to Carl E. Hicks, Armada, Mich. 48005. The previous examples are simply illustrative of the type of planer board design that may be modified for the present invention and as such the present invention is not limited to one specific model.

The capture system 10 will be deployed from the host vessel 12 relative to the stow or lift device 15. In FIGS. 1 and 2, the lift device 15 is a boom with winch. The lift device 15 can be a crane or involve a ramp system that is lowered proximate the water level. The capture system 10 includes a pair of side planers 14 towed by a cable 16 from host vessel 12. It is envisioned that a down diver 18 will be attached to the cable 16 at an intermediate point between the side planers 14. A down diver 18 is a weighted structure with a cable attachment to maintain the cable at a specified depth relative to the side planers 14. The relative velocity of the host vessel 12 will direct the side planers 14 outboard. The down diver 18 will direct the cable 16 below the surface between the side planers 14. The depth of the down diver 18 will be determined by the type of off-board vessel 11 to be captured. The off-board vessel 11 will first deploy a capture hook 20 either by a line or a fixed strut. It is envisioned that the capture hook 20 will include a self-locking feature to maintain the cable after contact is made. The self-locking feature may be a hinged or torsioned strap 19 that extends across the hook opening. As the off-board vessel 11 maintains speed or is stationary, the host vessel 12 will advance at a greater speed than the off-board vessel 11 and direct the capture system 10 under the off-board vessel 11. The off-board vessel 11 may be on the surface or underwater. The capture hook 20, extending from the off-board vessel will contact and attach to the capture cable 16. A winch system 22 will then direct the off-board vessel 11 to the lift system 15 of the host vessel 12.

Figure 3:
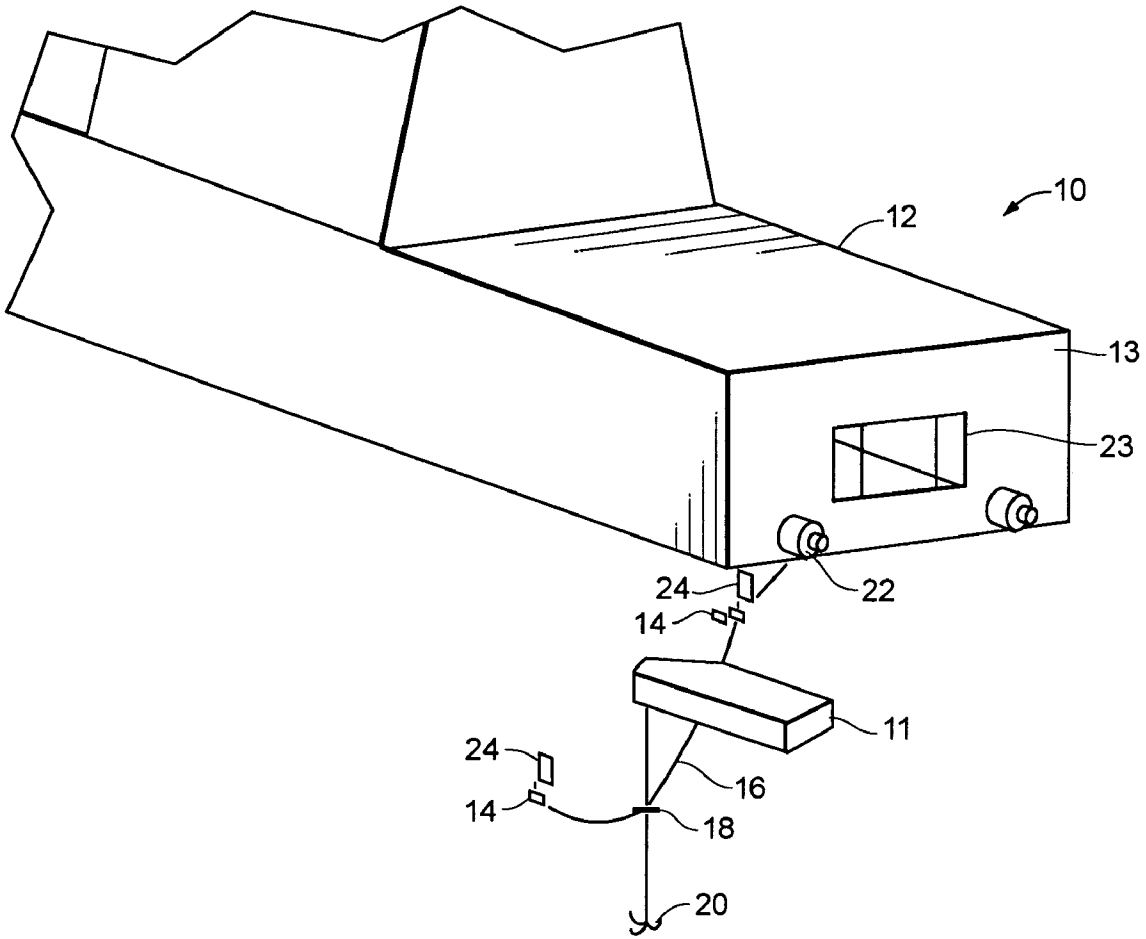
FIG. 3 is a perspective view of the capture of an off-board vessel utilizing the first embodiment of the present invention.
Figure 4:
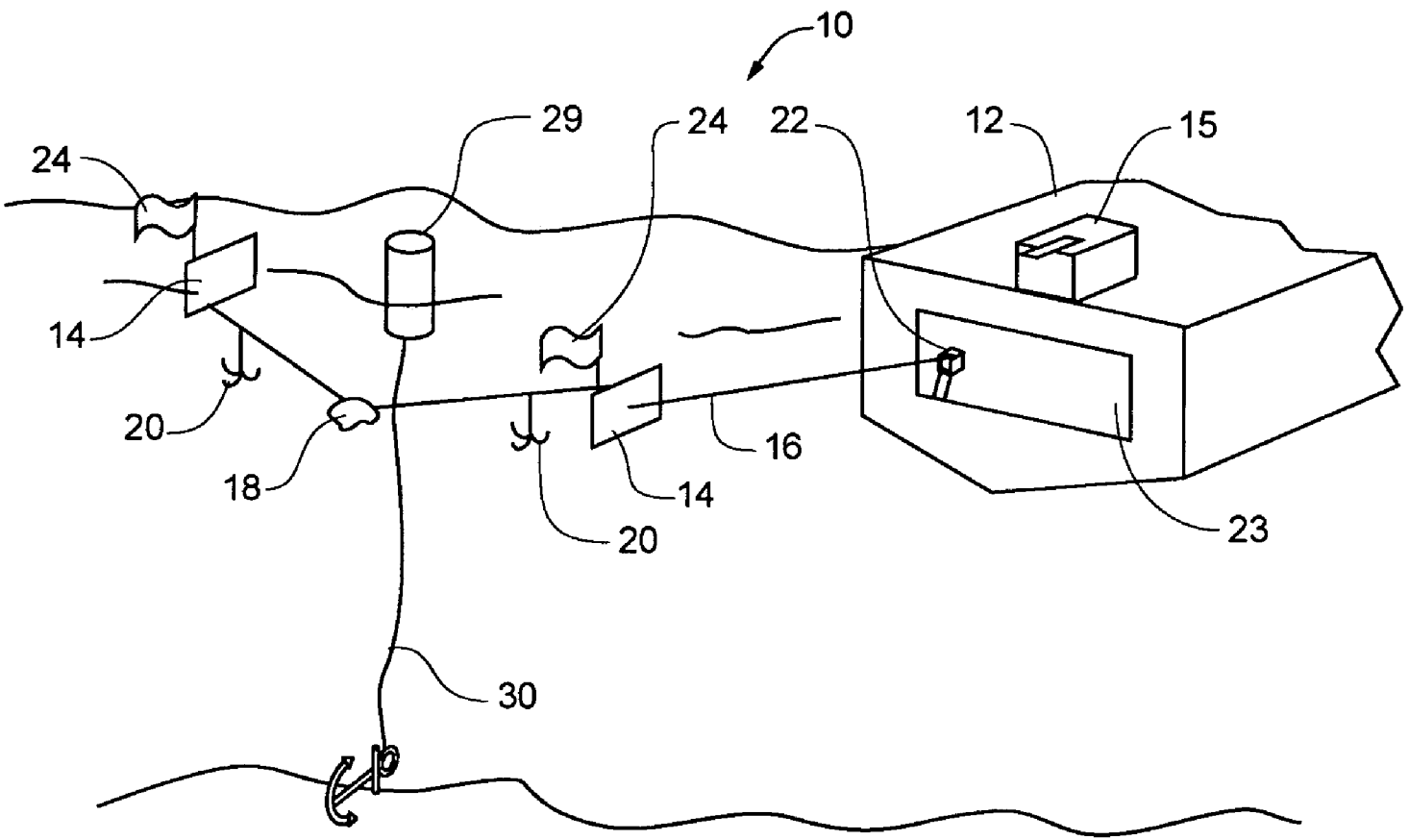
FIG. 4 is a perspective view of the capture of an off-board sensor utilizing the first embodiment of the present invention.
Figure 5:
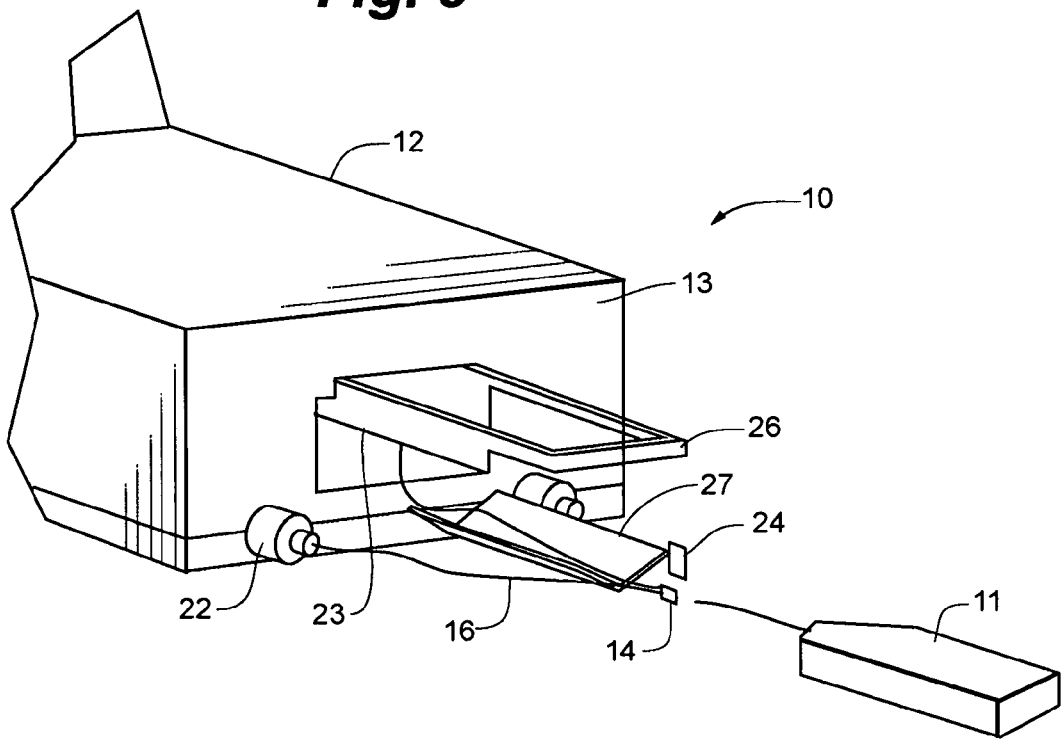
FIG. 5 is a perspective view of the capture of an off-board vessel utilizing the first embodiment with a retractable lift.

FIGS. 3 and 4 illustrates an embodiment where the winch system 22 is mounted on the aft 13 of vessel 12. In addition, a storage well 23 is located in the aft 13 for storing the off-board vessel 11. The capture system 10 includes a pair of side planers 14 with flags 24 mounted to improve efficiency of the capture. Storage well 23 could include a retractable ramp that would extend into the water for recovery of the off-board vessel 11. Storage well 23 may also include a lift system 26 as illustrated in FIG. 5, that would extend above the water from the aft 13 of the vessel 12. The lift system 26 would include a sling 27 for raising the off-board vessel 11 above the water before being drawn into storage well 23.

The first embodiment is not limited to the recovery of off-board vessels. The present invention may be also be used to recover a swimmer or diver if provided with the proper harness and connection mechanism. It is envisioned that a drop line and hook 20 could be provided to the swimmer to assist in recovery. Moreover, the first embodiment can also be used to pick-up items anchored to the ocean bottom. In this scenario the side planer system 10 would be directed at the anchor line 30 of the tethered item. For example, as illustrated in FIG. 4, this method could be used in the recovery of military or oceanographic sensors 29. Cable 16 could include one or more capture hooks 20 to assist in retrieving sensor 29.

Figure 6:
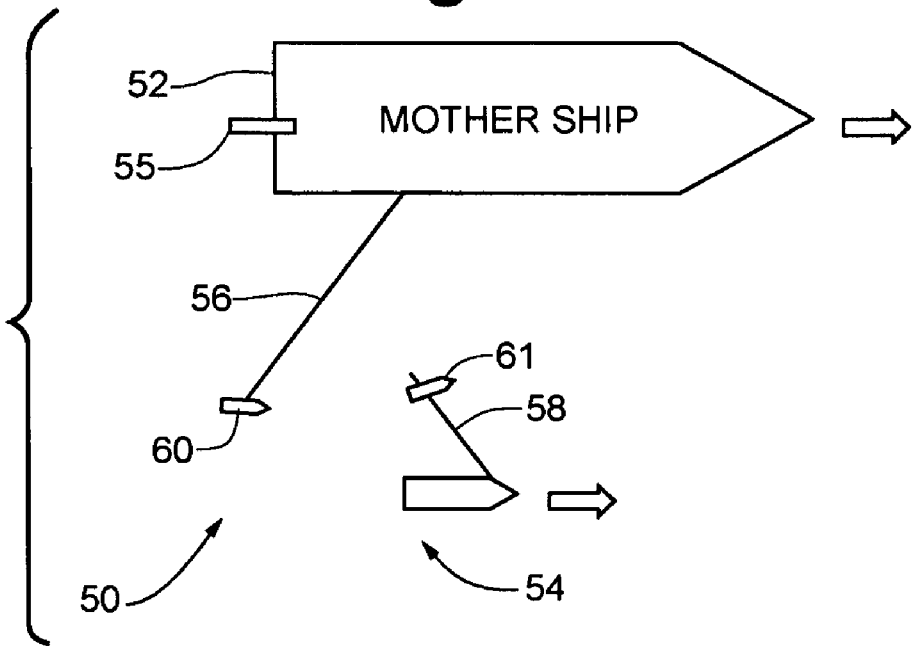
FIG. 6 includes an overhead view of an alternate embodiment of the present invention.
Figure 7:
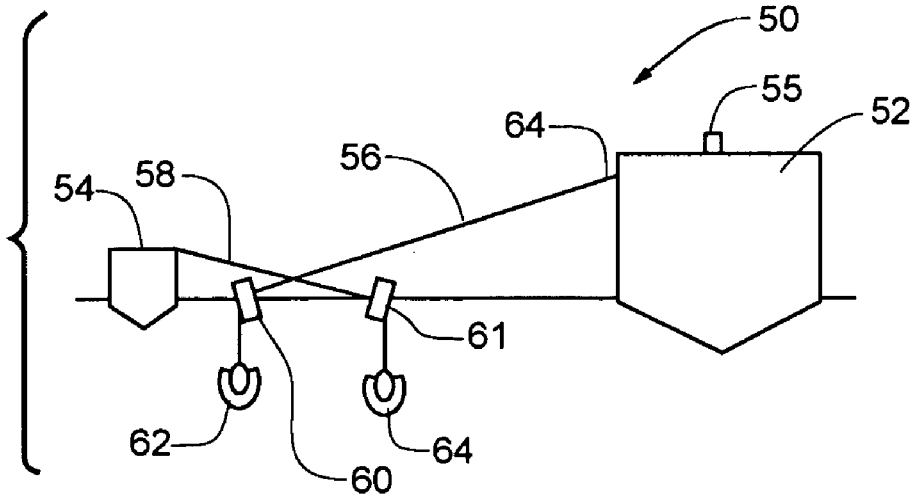
FIG. 7 is a front view of the alternate embodiment of the present invention.

In an alternate embodiment, as illustrated in FIGS. 6 and 7, capture system 50 shows both the host vessel 52 and the off-board vessel 54 deploying cables 56, 58 with side planers 60, 61 to which a capture hook 62, 64 is attached. For example, the host vessel 52 will deploy a single side planer 60 from which a capture hook 62 is attached. Likewise, the off-board vessel 54 will deploy a single side planer 61 from which a capture hook 64 is attached. The two vessels 52, 54 will proceed on a roughly parallel course so that the side planer 60 of the host vessel 52 is directed inboard of the side planer 61 of the off-board vessel 54. The crossing cables 56, 58 will result in at least one capture hook 62 contacting at least one of the respective side planer cables 56, 58. The off-board vessel 54 will then be drawn to the host vessel 52 by winch 64 and loaded on-board by boom 55 or any acceptable method.

Figure 8:
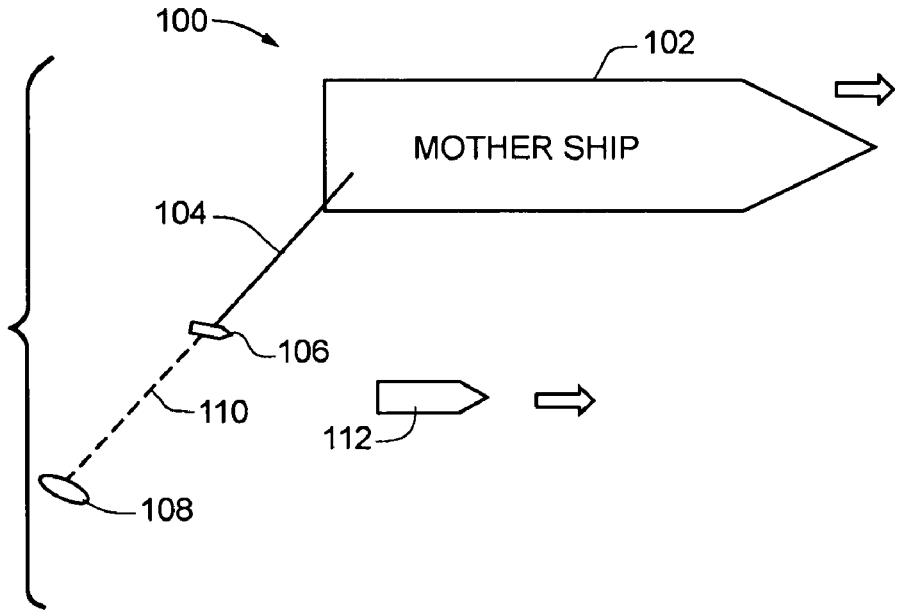
FIG. 8 includes an overhead view and a side view of an another alternate embodiment of the present invention.
Figure 9:
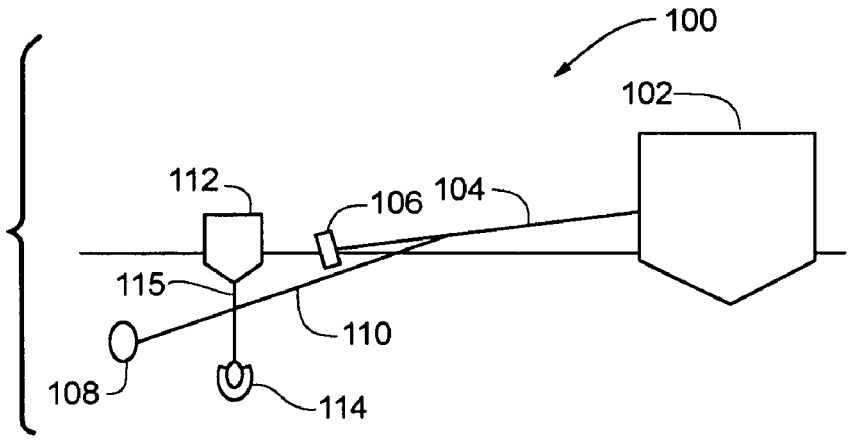
FIG. 9 includes a side view of the alternate embodiment illustrated in FIG. 8 of the present invention.

In an another alternate embodiment, capture system 100, as illustrated in FIGS. 8 and 9, involves the host vessel 102 deploying a cable 104 with a side planer 106. A diving rig 108 is suspended from the diving rig cable 110 between the host vessel 102 and the side planer 106 so as to drift downstream of the side planer 106 at a prescribed depth. The diving rig 108 should be set at a depth greater than the expected depth of the propeller of the off-board vessel 112. The off-board vessel 112 is required to deploy a catch hook 114 from cable 115. The side planer 106 overtakes the off-board vessel 112 as the host vessel 102 continues under speed. The off-board vessel 112 can be stationary or be moving at a velocity less than the host vessel 102. After the side planer 106 passes close by the off-board vessel 112, the diving rig cable 110 restraining the diving rig 108 intercepts the catch hook 114. The cable 104 is then winched toward the host vessel 102 for recovery of the off-board vessel 112.

Figure 10:
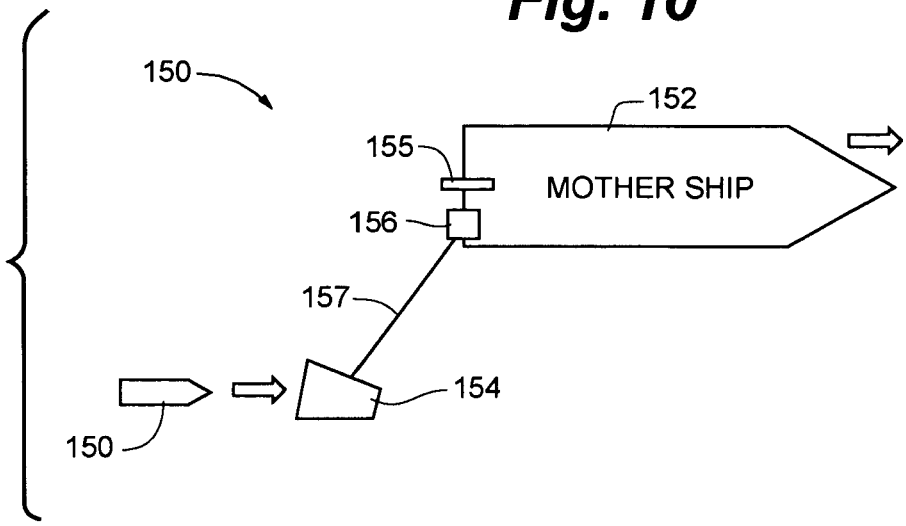
FIG. 10 includes an overhead view of an additional embodiment of the present invention.
Figure 11:
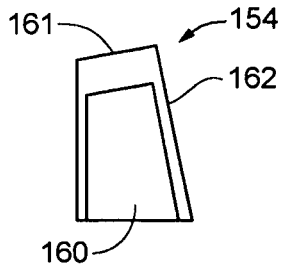
FIG. 11 is a top view of the side planning cradle of the embodiment illustrated in FIG. 10.

In an additional embodiment, capture system 150, as illustrated in FIG. 10, requires the host vessel 152 or mother ship to be fitted with a side planning cradle 154 that is selectively deployed by a cable winch system 156. The side planning cradle 154 is deployed on a cable 157 aft of the host vessel 152 while the host vessel 152 maintains speed. The off-board vessel 158 proceeds at a greater speed to overtake the side-planning cradle 154. The side-planning cradle 154, illustrated in FIG. 11 includes a docking portion 160 that travels below the surface. Like a side planer, the side planning cradle 154 includes an angled bow 161 and side wall 162 that serves to direct the side planning cradle 154 outboard from the vessel 152. The off-board vessel 158 increases speed relative to the side-planning cradle 154 so as to propel itself onto the docking portion 160 below the surface. It is envisioned that side-planning cradle 154 would either be shorter than the off-board vessel 158 or contain a channeled groove to protect the propeller system of the off-board vessel 158 during the capture process. Once the off-board vessel 158 is disposed on the side-planning cradle 154 the winch system 156 would retrieve the off-board vessel 158. An existing boom or crane system 155 would then raise the combined off-board vessel and side-planning cradle onto the host vessel 152. In an alternative embodiment, the side-planning cradle could remain attached to the boom or crane system for simply scooping an off-board vessel out of the water.

Figure 12:
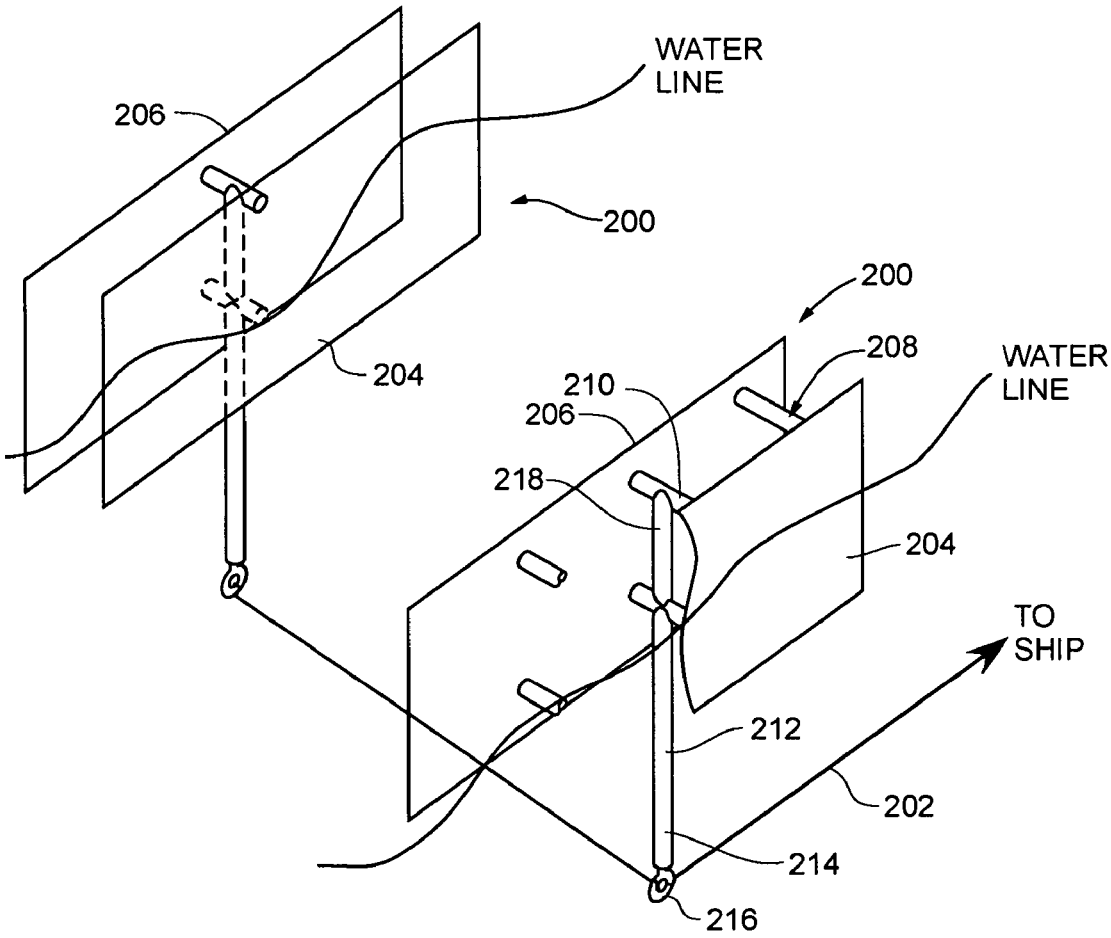
FIG. 12 is a perspective view of an alternate side planer design.

FIG. 12 includes a novel alternative side planer design 200. First side planer 200 is tethered to vessel by cable 202. Cable 202 then extends to second side planer 200. Side planer 200 includes a multiple board design wherein first board 204 is spaced from second board 206 by strut assembly 208. The boards 204 and 206 are constructed to include a buoyant material or flotation chambers to prevent sinking. The boards 204 and 206 may also include a keel or weighted section to insure a selected face remains at or above the waterline. Strut assembly 208 includes at least one cross strut 210 that acts as a spacer between boards 204 and 206. In FIG. 12, the first board 204 is separated from second board 206 by six cross struts 210. Strut assembly 208 further includes a cable strut 212 that extend parallel to first board 204 and second board 206 below the waterline. Cable strut 212 could be a single strut or a telescopic design so as to vary its length. The distal end 214 of cable strut 212 includes a cable tether mount 216. The proximal end 218 of cable strut 212 is attached to one or more cross strut 210. The connecting cable 202 would them extend from the cable tether mount 216 of the first side planer 200 to the cable tether mount 216 of the second side planer 200. In effect, the cable strut 202 may eliminate the need for a down planer or down diver.

The embodiments illustrated in the present figures may also be used for launching of an off-board vessel. For example, the embodiment illustrated in FIG. 5 would allow the off-board vessel 11 to be placed in cradle 27 prior to deployment from vessel 12. The lift system 26 is then extended aft 13 of the vessel 12 and lowered to the water while still underway. The force of the water could be used to lift the off-board vessel 11 from cradle 27. Likewise, the boom depicted in FIGS. 1, and 7 can be used to lower the off-board vessel.

It will be understood that the invention may be embodied in other specific forms without departing from the spirit or central characteristics thereof. The present examples and embodiments are illustrative and not restrictive. Moreover, the present invention is not intended to be limited to the details given herein.

The invention claimed is:

1. An apparatus for recovery and launch of an off-board vessel from a host vessel, the host vessel having a greater displacement than the off-board vessel, the off-board vessel including a deployable hook, said hook connected to the off-board vessel by an off-board vessel cable, the apparatus comprising:

a winch mounted to the host vessel;

a capture system operably connected to the winch by a capture cable, said capture system including a first side planer and a second side planer operably connected to the first side planer by the capture cable, wherein the first side planer is closer to the host vessel than the second side planer, said capture system is directed toward the off-board vessel; and a stow system mounted on the host vessel, said stow system transporting an off-board vessel between the host vessel and the capture system.

2. The apparatus of claim 1 wherein a diving rig is disposed on the capture cable intermediate the first side planer and the second side planer, said diving rig directing the capture cable to a depth greater than the first side planer.

3. The apparatus of claim 2 wherein the diving rig can be set for a prescribed depth relative to the first side planer.

4. The apparatus of claim 1 wherein the first side planer and the second side planer each include a cable strut, said cable strut extending distally from the first side planer and second side planer to a set depth, said cable strut including at a distal end a cable tether so as to operably connect to the capture cable.

5. The apparatus of claim 1 wherein a capture hook is suspended from the capture cable, said capture hook including at least one barb.

6. The apparatus of claim 5 wherein the capture hook includes a self-locking clasp relative to each barb.

7. The apparatus of claim 1 wherein a diving rig is disposed on a second end of a diving cable, a first end of the diving cable connected to the capture cable intermediate the host vessel and the first side planer.

8. A method for recovering an off-board object by a moving host vessel, wherein the off-board object is either anchored or moving on a course parallel to the host vessel, the method comprising:

deploying a first side planer from the host vessel, said first side planer tethered to the host vessel by a capture cable;

deploying a second side planer from the host vessel, said second side planer connected to the capture cable;

directing the second side planer outboard relative to the host vessel;

directing the host vessel to intercept the off-board object;

capturing the off-board object, wherein capture occurs when the off-board object is contacted by the capture cable and drawn towards the host vessel by a stow system;

positioning the off-board object relative to the host vessel; and raising the off-board object from the water to a secure position relative to the host vessel.

9. The method of claim 8 further includes deploying a diving rig on the capture cable between the first side planer and the second side planer, said diving rig directing the capture cable to a depth below the depth of the first side planer.

10. The method of claim 8 further includes deploying at least one grapple hook suspended from the capture cable between the first side planer and the second side planer.

11. The method of claim 8 further includes deploying at least one grapple hook suspended from the first side planer.

12. The method of claim 8 further includes deploying a diver cable connected at a first end to a point intermediate the first side planer and the host vessel, the second end of the diver cable connected to a diving rig.

13. The method of claim 8 wherein the stow system is a boom with an attached winch mounted on the host vessel for lifting the off-board object on board the host vessel.

14. The method of claim 8 wherein the stow system is an aft ramp with an attached winch mounted on the host vessel, said winch pulling the off-board object onto the ramp.

15. The method of claim 8 wherein the stow system includes a storage well within the host vessel, said storage well externally accessible by the off-board object.

16. The method of claim 15 wherein the stow system further includes a lift system, said lift system including a harness that extends into the water to lift the off-board object into the storage well, the lift system extendable from within the storage well to a position cantilevered aft of the host vessel.

17. An apparatus for recovery and launch of an off-board vessel from a host vessel, the host vessel having a greater displacement than the off-board vessel, the off-board vessel including a deployable hook, said hook connected to the off-board vessel by an off-board vessel cable, the apparatus comprising:

a winch mounted to the host vessel;

a capture system operably connected to the winch by a capture cable, said capture system including a side planing cradle, said side planing cradle including a docking portion sized to accommodate the off-board vessel and an asymmetric bow that directs the side planing cradle outboard from the host vessel; and a stow system mounted on the host vessel, said stow system transporting an off-board vessel between the host vessel and the capture system.

18. An apparatus for recovery and launch of an off-board vessel from a host vessel, the host vessel having a greater displacement than the off-board vessel, the off-board vessel including a deployable hook, said hook connected to the off-board vessel by an off-board vessel cable, the apparatus comprising:

a winch mounted to the host vessel;

a capture system operably connected to the winch by a capture cable, said capture system including a first side planer for directing the capture system toward the off-board vessel; and a stow system mounted on the host vessel, said stow system transporting an off-board vessel between the host vessel and the capture system, wherein the stow system includes a boom for transferring the off-board vessel to the host vessel.

19. An apparatus for recovery and launch of an off-board vessel from a host vessel, the host vessel having a greater displacement than the off-board vessel, the off-board vessel including a deployable hook, said hook connected to the off-board vessel by an off-board vessel cable, the apparatus comprising:

a winch mounted to the host vessel;

a capture system operably connected to the winch by a capture cable, said capture system including a first side planer for directing the capture system toward the off-board vessel; and a stow system mounted on the host vessel, said stow system transporting an off-board vessel between the host vessel and the capture system, wherein the stow system includes a lifting cradle selectively extendable from an aft end of the host vessel, the lifting cradle including a harness suspending a ramp for holding the off-board vessel.

* * * * *

UNITED STATES PATENT AND TRADEMARK OFFICE

CERTIFICATE OF CORRECTION

PATENT NO. : 7,350,475 B2
APPLICATION NO. : 11/522859
DATED : April 1, 2008
INVENTOR(S) : Borgwarth et al.

It is certified that error appears in the above-identified patent and that said Letters Patent is hereby corrected as shown below:

Column 2, Lines 19, 27, 28:
Delete "stem" and insert --stern--.

Column 7, Line 30:
Delete "them" and insert --then--.

Signed and Sealed this

Thirtieth Day of September, 2008

JON W. DUDAS
*Director of the United States Patent and Trademark Office*